US007343959B2

(12) United States Patent
Motegi et al.

(10) Patent No.: US 7,343,959 B2
(45) Date of Patent: Mar. 18, 2008

(54) PRESSURE CASTING METHOD OF MAGNESIUM ALLOY AND METAL PRODUCTS THEREOF

(75) Inventors: Tetsuichi Motegi, Chiba-ken (JP); Kazutoshi Takayama, Nagano-ken (JP); Kiyoto Takizawa, Nagano-ken (JP)

(73) Assignees: Nissei Plastic Industrial Co., Ltd., Nagano-ken (JP); Chiba Institute of Technology, Chiba-ken (JP)

( * ) Notice: Subject to any disclaimer, the term of this patent is extended or adjusted under 35 U.S.C. 154(b) by 0 days.

(21) Appl. No.: 11/504,958

(22) Filed: Aug. 16, 2006

(65) Prior Publication Data

US 2006/0272750 A1 Dec. 7, 2006

(51) Int. Cl.

| | |
|---|---|
| ***B22D 17/08*** | (2006.01) |
| ***B22D 23/00*** | (2006.01) |
| ***B22D 25/00*** | (2006.01) |
| ***B22D 27/04*** | (2006.01) |

(52) U.S. Cl. ..... 164/113; 164/312; 164/900

(58) Field of Classification Search ..... 164/113, 164/312, 900

See application file for complete search history.

(56) References Cited

U.S. PATENT DOCUMENTS 5,501,748 A 3/1996 Gjestland et al.

2001/0020526 A1* 9/2001 Motegi et al. ..... 164/122

FOREIGN PATENT DOCUMENTS

| | | |
|---|---|---|
| EP | 1 132 162 A1 | 9/2001 |
| JP | 90 10893 | 1/1997 |
| JP | 2001-252759 | 9/2001 |

* cited by examiner

*Primary Examiner*—Kuang Lin
(74) *Attorney, Agent, or Firm*—Weingarten, Schurgin, Gagnebin & Lebovici LLP

(57) ABSTRACT

The present invention provides a pressure casting method of a magnesium alloy. In the method, a molten magnesium alloy is cooled to form a partially molten state containing a solid-phase, and the partially molten state is further cooled to form a solid-phase granularly crystallized solid material. The solid material is partially-melted and pressure cast into a mold by a molding machine. A ratio of primary crystals in said solid material is set to 55 to 65%. The solid material is partially-melted in a solid-phase and liquid-phase coexisting state at a selected heating temperature so that a semi-solid having thixotropic properties and having the size of a main solid phase of 50 to 250 μm and a solid-phase ratio of 30 to 70% is formed. The semi-solid is pressure cast into a mold through a nozzle while maintaining the semi-solid state to form metal products having a ratio of primary crystals of 20 to 50%.

3 Claims, 9 Drawing Sheets

(A)

(B)

Solid phase ratio (granular crystal) 61%

(A)

Semi-solid temperature 570$^0$C

Holding time 0 minute (B)

Solid phase ratio 64%

(A)

Semi-solid temperature 570$^0$C

Holding time 30 minutes (B)

Solid phase ratio 69%

(A)

Semi-solid temperature 590$^0$C

Holding time 0 minute (B)

Solid phase ratio 48%

(A)

Semi-solid temperature 590°C

Holding time 30 minutes (B)

Solid phase ratio 65%

(A)

Semi-solid temperature 580$^0$C (B)

Solid phase ratio 46%

(A)

Semi-solid temperature 585$^0$C (B)

Solid phase ratio 47%

(A)

Semi-solid temperature 590$^0$C (B)

Solid phase ratio 50%

(A)

Semi-solid temperature 595$^0$C (B)

Solid phase ratio 28%

PRESSURE CASTING METHOD OF MAGNESIUM ALLOY AND METAL PRODUCTS THEREOF

BACKGROUND OF THE INVENTION

1. Field of the Invention

The present invention relates to a casting method of using a granularly crystallized magnesium alloy solid as a casting material, melting the solid material to state in which a solid-phase and a liquid-phase coexists to form metal products by a pressure casting means, and to their metal products.

2. Description of the Related Art

In a conventional manufacturing method for a product from a partially molten metal, a molten alloy is held in a state in which a solid-phase and a liquid-phase coexist in an insulating vessel for a desired time, generating many fine spherical primary crystals and pressure casting them in a mold of a die cast machine at a desired liquid phase ratio to form cast products (see for example Patent Reference 1).

Further, in molding of metal products using a magnesium alloy, a solid material potentially holding thixotropy is heated in a partially molten state and the obtained material is charged into a mold by an injection apparatus (see for example Patent Reference 2)

[Patent Reference 1 ]

Japanese A-HEI 9-10893 (on pages 3 to 5, FIG. 9)

[Patent Reference 2]

JP-A-2001-252759 (on pages 6 and 7, FIG. 1)

The above-mentioned patent reference 1 describes a pressure casting method of cast products by a die cast machine including the steps of pouring a molten alloy into a tilt cooling jig held at a temperature lower than the melting point to flow down and holding the alloy in an insulating vessel in a state at a temperature equal to or lower than a liquidus line temperature and higher than a eutectic temperature or a solidus line temperature for five seconds to 60 minutes to form the cast products in a liquid phase ratio of 20 to 90%, preferably 30 to 70%.

Further, the Patent Reference 2 describes a casting method including the steps of allowing a molten magnesium alloy to flow on a cooling tilt plate to cool until partially molten, reserving the alloy in a reservoir until it becomes a metal slurry having fine spherical crystals, then solidifying the slurry by rapidly cooling it to form a metal material potentially holding a thixotropic performance, and melting the metal material into a partially molten state magnesium alloy exhibiting a thixotropic performance for charging into a mold by an injection apparatus.

In the prior art described in Patent Reference 1, after a molten alloy is cooled to a partially molten state the obtained alloy must be held in an insulating vessel until it has a desired liquid phase ratio. Thus it takes much time from the melting of the material to the pressure casting of products. In order to shorten the time, many insulating vessels and their transfer means are required. Further, since the material is cooled close to a lower temperature that is close to the casting temperature and is transferred to a molding machine to conduct molding immediately, some molding machines have a problem, and cannot be adapted.

Even in the prior art described in Patent Reference 2, since the solid phase ratio of a partially molten slurry is high, so much time is also needed for potentially holding the thixotropic performance. However, the molding steps of remelting a rapidly cooled solidified metal material in a partially molten state by a molding machine and pressure casting the obtained material into a mold in a state having thixotropic properties can be completed in a short time. Further, the supply of the metal material into the molding machine is also easy, and continuous casting is also possible, whereby the prior art is adaptable to the casting machine.

However, in Patent Reference 2, it is difficult to set temperature conditions and a holding time for metal slurry crystals that are crystallized out at a solid-phase and liquid-phase coexisting temperature region to be uniform spherical crystals, and there is a problem in maintaining a solid-phase ratio, which is preferable for molding. The present inventors have studied these problems. As a result they have found that even if crystals do not become uniform spherical ones, if a primary crystal ratio in which a solid material is granularly crystallized is within a certain range, the primary crystal becomes a sphered solid phase in a solid-phase and a liquid-phase coexisting state, and at the same time a main solid phase has a solid-phase ratio preferable for casting in a grain size of 50 μm or more. Also, if the holding time is within 30 minutes, the material is pressure cast into molds without changing the set conditions so that a number of metal products of a magnesium alloy that are extremely excellent in a distribution state of primary crystals can be formed.

SUMMARY OF THE INVENTION

In view of the above problems, the object of the present invention is to provide a new pressure casting method of a magnesium alloy comprising the steps of melting previously granularly crystallized solid material to form a partially molten state (hereinafter referred to as a "semi-solid") having thixotropic properties in a state in which a solid-phase and a liquid-phase coexist (hereinafter referred to as a "semi-solid") and pressure casting the semi-solid into a mold, wherein the grain diameter and solid-phase ratio in a solid phase in the semi-solid are set to a preferable state for molding. In this manner, metal products having an excellent metal structure can be formed stably.

This invention comprises the steps of cooling a molten magnesium alloy to form a partially molten state containing a solid-phase, further cooling the partially molten state to form a solid-phase granularly crystallized solid material, wherein a ratio of primary crystals of said solid material is set to 55 to 65%, and partially melting the solid material to pressure cast it into a mold by a molding machine. In the partially melting step, the solid material is melted to be a semi-solid body in a state in which a solid-phase and a liquid-phase coexist. In this state, the semi-solid has a main solid phase of 50 to 250 μm and a solid-phase ratio of 30 to 70%. The semi-solid is pressure cast into a mold through a nozzle while maintaining the semi-solid state to form metal products having a ratio of primary crystals of 20 to 50%.

Further, in this invention, the temperature of a heating means in the molding machine for holding the semi-solid in the semi-solid state is set at a temperature 5 to 15° C. higher than the temperature of the semi-solid from the time of the start of melting of the solid material to the pressure casting of the semi-solid. In addition, the semi-solid is pressure cast from a nozzle having a diameter of 8 to 15 mm into a mold through a gate having a thickness of 1 mm or less.

The metal product of this invention is a metal product molded by the above-mentioned pressure cast molding method of a magnesium alloy which comprises a metal structure whose main primary crystal is spherical and has a diameter of 10 μm or more, and has a wall thickness of 0.4 to 1.5 mm, preferably 0.6 to 1.0 mm.

DESCRIPTION OF THE PREFERRED EMBODIMENTS

In each Figure, (A) is a photograph taken by a metallurgical microscope and (B) is a view in which a part of the photograph is two-valued into black and white by image processing and the grain diameter of a solid phase and the solid phase ratio or a primary crystal ratio are calculated from the dot number of the white and the black dots.

Figure 1:
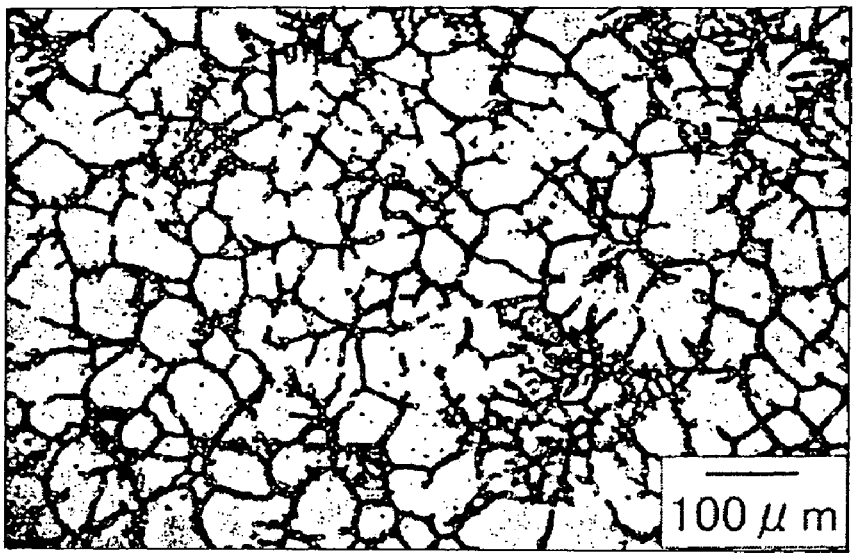
FIG. 1(A) is a view of a structure in a metallurgical micrograph of a magnesium alloy (AZ91D) used in a pressure casting molding method according to this invention.
FIG. 1(B) is a view in which the micrograph is two-valued in black and white by image processing.
Figure 1:
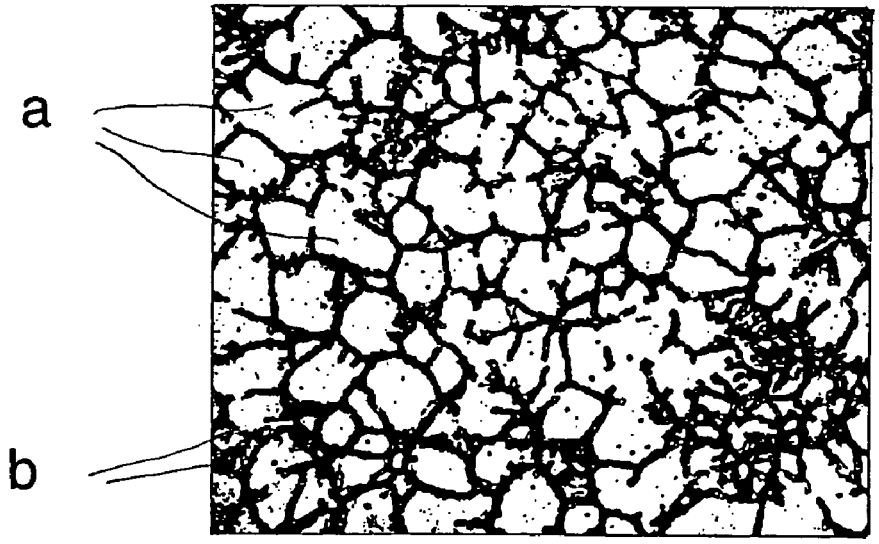

FIG. 1 shows a metal structure of a magnesium alloy (AZ91D) used as a solid material in this invention. The solid material of the granular crystal structure is manufactured by the steps of heating and melting a magnesium alloy at a temperature higher than the liquidus line temperature, allowing the molten alloy to flow down on a surface of a cooled (for example 60° C.) tilt plate, cooling the alloy to a temperature at which a solid-phase and liquid-phase below the liquidus line temperature coexist (hereinafter referred to as a solid-phase and liquid-phase coexisting temperature) to produce a solid phase, then holding the solid phase and liquid phase coexisting temperature for a desired time until the solid phase ratio reaches 55 to 65% of a primary crystal a of a solid material, and cooling the alloy below the solidus line temperature. As one example, the solid material is manufactured by cooling a magnesium molten alloy at 605° C. to a temperature 5° C. to 25° C. lower than 595° C. (the liquidus line temperature), holding the temperature in its range for one minutes and then rapidly cooling the alloy below the solidus line temperature.

As the form of use of the solid materials, any type of the solid material such as a round bar, ingot or the like, and of a granular solid material such as a chip, pellet or the like may be selected. The material form can be optionally selected for the structure of the metal casting machine used. Further, regarding the metal casting machine, a metal casting machine having the same structure as an incline screw injection molding machine, a plunger injection molding machine, a (pre-plasticizing system) injection molding machine or the like, or a molding machine that can pressure cast a semi-solid charged into a cylinder into a mold from a nozzle through a gate, such as a die cast machine or the like, may all be adopted.

The molding of metal products of the above-mentioned solid material is performed as follows. First, a solid material is made a semi-solid in a solid-phase and liquid-phase state at a selected melting temperature. Then the temperature of the semi-solid is held at the liquidus line temperature or less and the solidus line temperature or more to maintain a solid-phase and liquid-phase coexisting state. After that the semi-solid is pressure cast into a mold from a nozzle through a gate.

In the above-mentioned melting step, when a solid material reaches the solidus line temperature or more, eutectic crystals b in the metal structure are melted to be semi-solid liquid phases b. And a primary crystal a is dispersed into the liquid-phase as a solid-phase a'. Alternatively, corners of the primary crystal a, which are liable to be influenced by heating, are melted to become sphered solid phases.

The size (grain diameter) of this main solid phase a' and the solid-phase ratio of the semi-solid are changed within ranges of 50 to 250 μm and of 25 to 75%, respectively, by the melting temperature of the solid material and the holding temperature and time for the semi-solid. If the solid material has a solid phase a' of a size in this range (most preferably 50 to 100 μm and the average grain diameter of 80 μm) and a solid phase ratio in this range (preferably 30 to 70%), pressure casting into a mold can be carried out without any trouble while maintaining thixotropic performance (viscous fluid performance).

Figure 2:
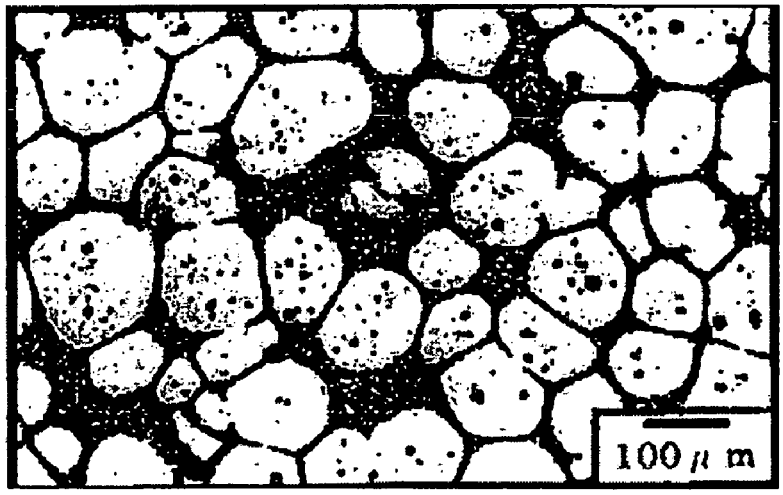
FIG. 2(A) is a view of a structure in a metallurgical micrograph of a solid obtained by rapidly cooling a semi-solid in a solid-phase and liquid-phase coexisting state (570° C.)
FIG. 2(B) is a view in which the micrograph is two-valued in black and white by image processing.
Figure 2:
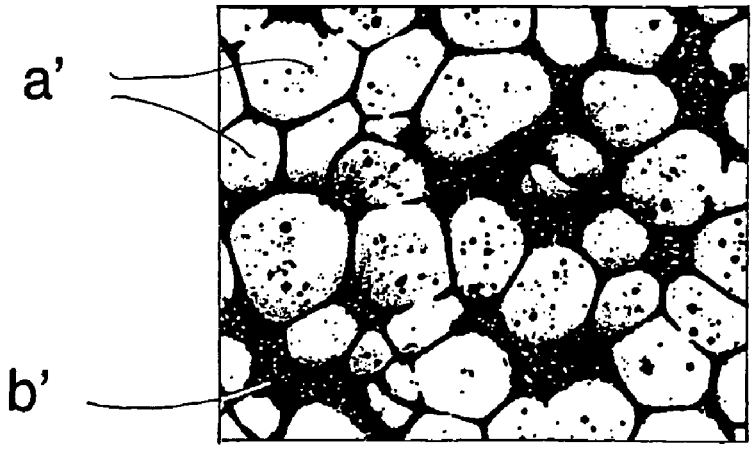
Figure 3:
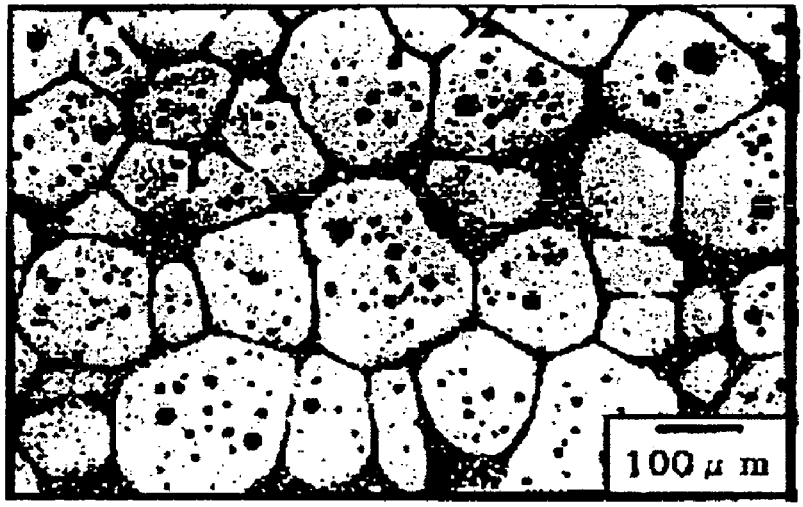
FIG. 3(A) is a view of a structure in a metallurgical micrograph of a solid obtained by rapidly cooling the semi-solid after holding it for 30 minutes in a solid-phase and liquid-phase coexisting state (570° C.)
FIG. 3(B) is a view in which the micrograph was two-valued in black and white by image processing.
Figure 3:
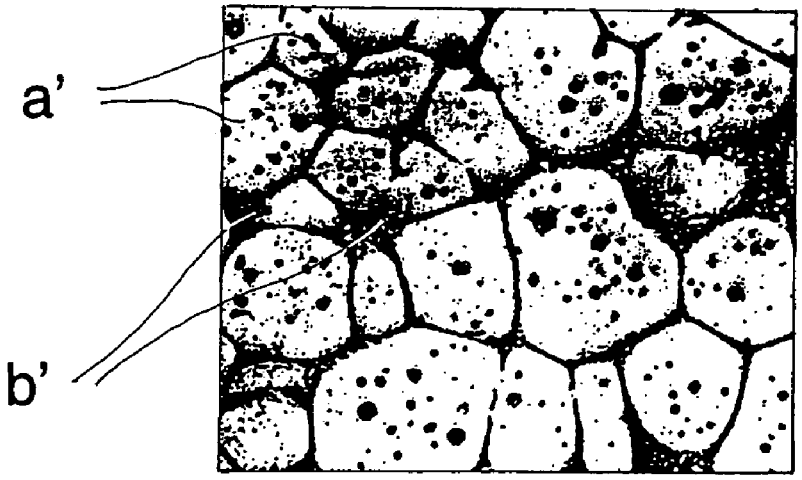

FIG. 2 is a metal structure of a solid obtained by rapidly cooling a semi-solid produced when a solid material having a ratio of a primary crystal a of 61% and a grain diameter of 50 to 100 μm shown in FIG. 1 has been melted at 570° C., without a holding time. The primary crystal a of this solid material before melting has a solid phase a' of 100 to 200 μm by melting so that the solid phase ratio is increased to 64%. Further, even a metal structure of a solid rapidly cooled after holding a semi-solid at a melting temperature of 570° C. for 30 minutes has no extreme enlargement of the solid phase a' due to a lapse of time and grows generally, as shown in FIG. 3. However, the main solid phase a' reaches a size of 150 to 250 μm and the solid phase ratio is increased to 69% at most.

Figure 4:
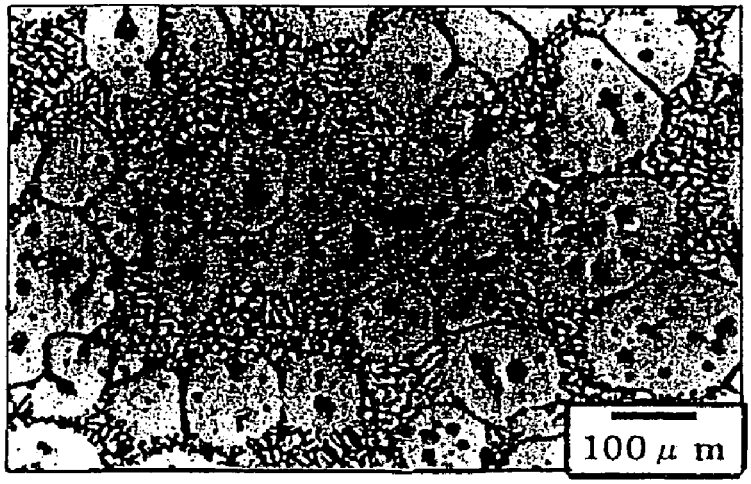
FIG. 4(A) is a view of a structure in a metallurgical micrograph of a solid obtained by rapidly cooling a semi-solid in a solid-phase and liquid-phase coexisting state (590° C.)
FIG. 4(B) is a view which the micrograph is two-valued in black and white by image processing.
Figure 4:
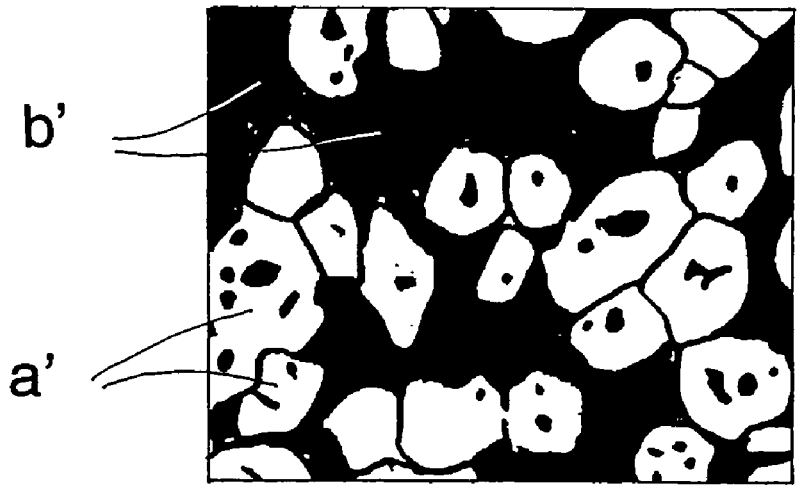
Figure 5:
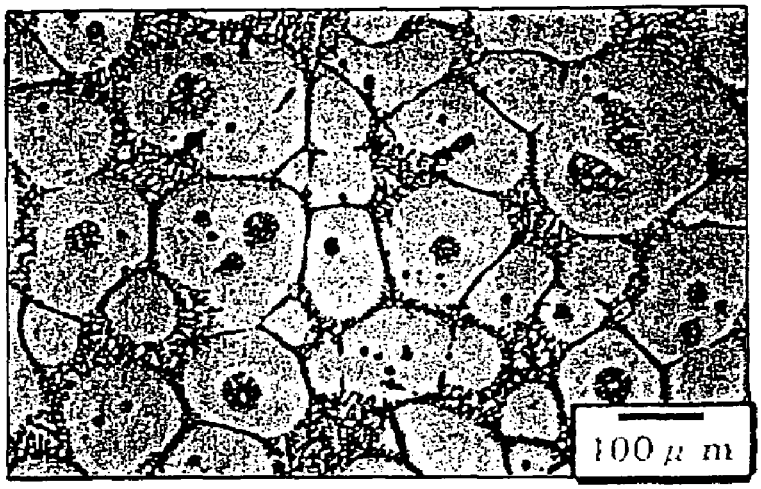
FIG. 5(A) is a view of a structure in a metallurgical micrograph of a solid obtained by rapidly cooling the semi-solid after holding the semi-solid for 30 minutes in a solid-phase and liquid-phase coexisting state (590° C.)
FIG. 5(B) is a view in which the micrograph is two-valued in black and white by image processing.
Figure 5:
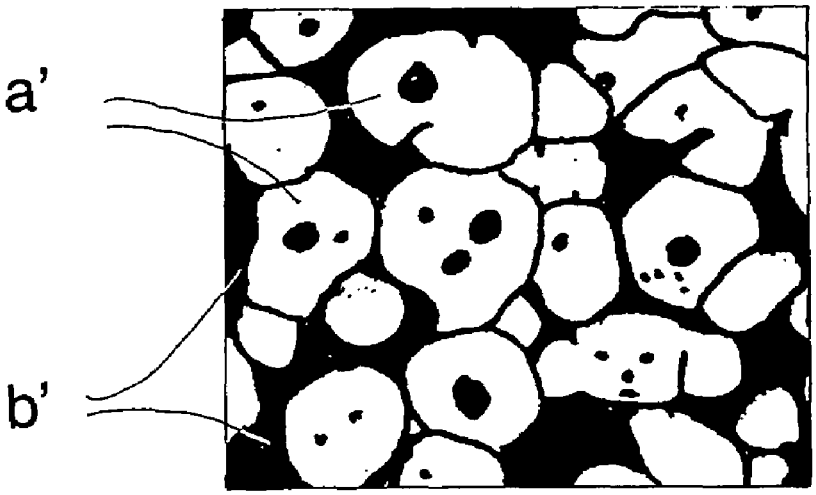
Figure 6:
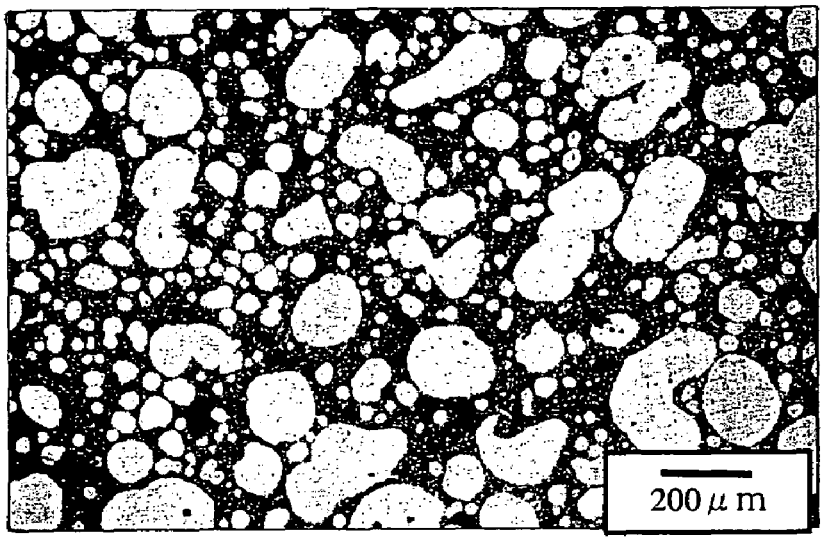
FIG. 6(A) is a view of a structure in a metallurgical micrograph of a metal product molded of a semi-solid in a solid-phase and liquid-phase coexisting state (580° C., holding time of 25 minutes)
FIG. 6(B) is a view in which the micrograph is two-valued in black and white by image processing.
Figure 6:
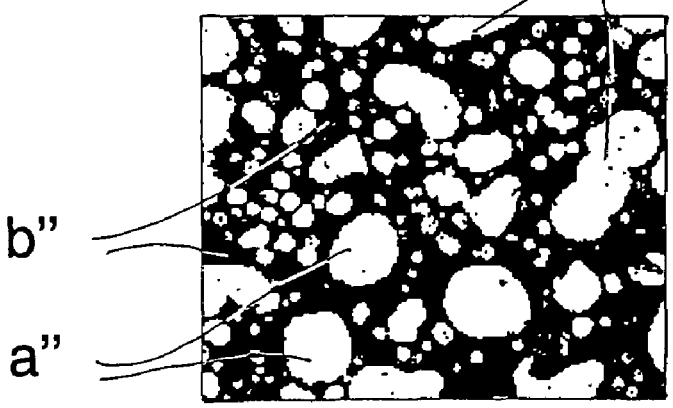
Figure 7:
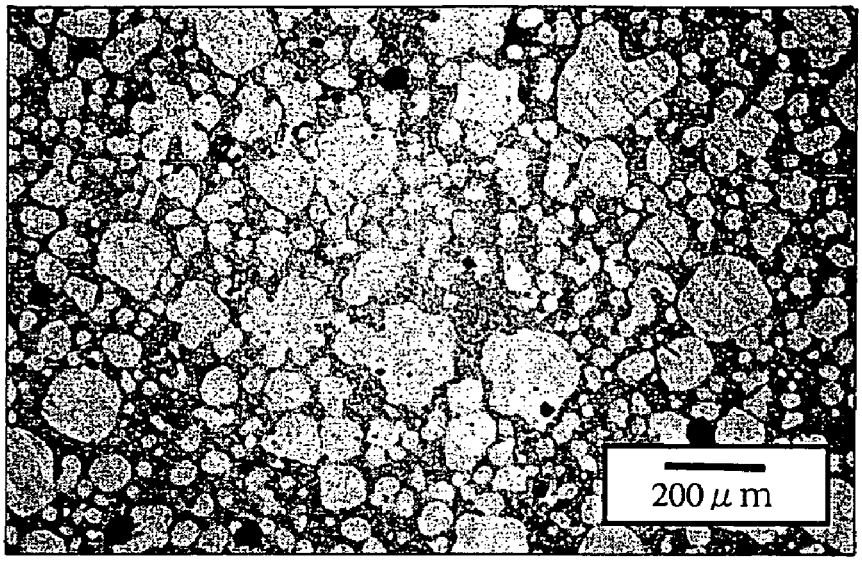
FIG. 7(A) is a view of a structure in a metallurgical micrograph of a metal product molded of a semi-solid in a solid-phase and liquid-phase coexisting state (585° C., holding time of 25 minutes)
FIG. 7(B) is a view in which the micrograph is two-valued in black and white by image processing.
Figure 7:
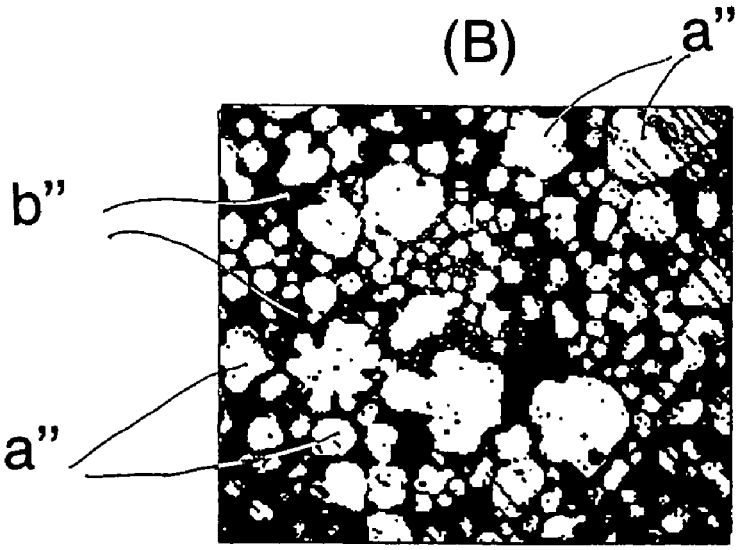
Figure 8:
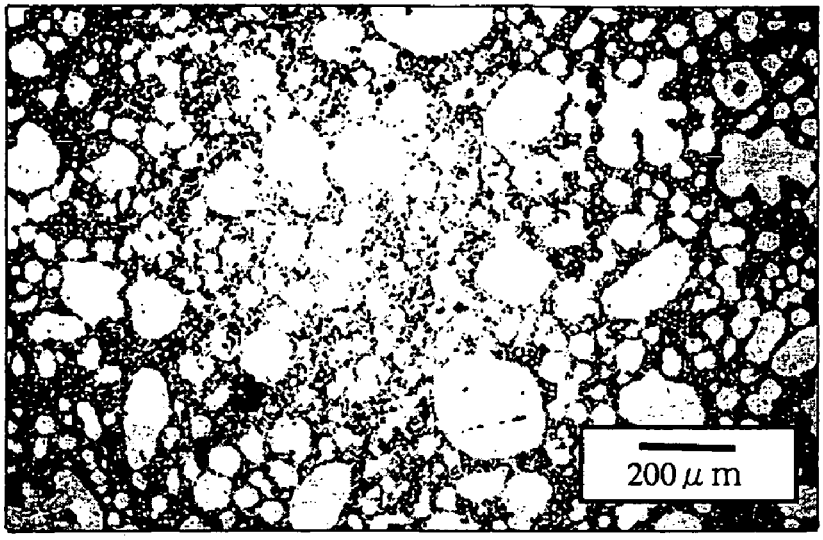
FIG. 8(A) is a view of a structure in a metallurgical micrograph of a metal product molded of a semi-solid in a solid-phase and liquid-phase coexisting state (590° C., holding time of 25 minutes)
FIG. 8(B) is a view in which the micrograph is two-valued in black and white by image processing.
Figure 8:
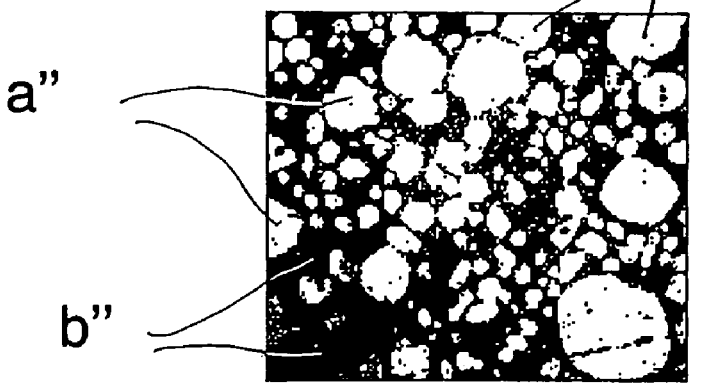
Figure 9:
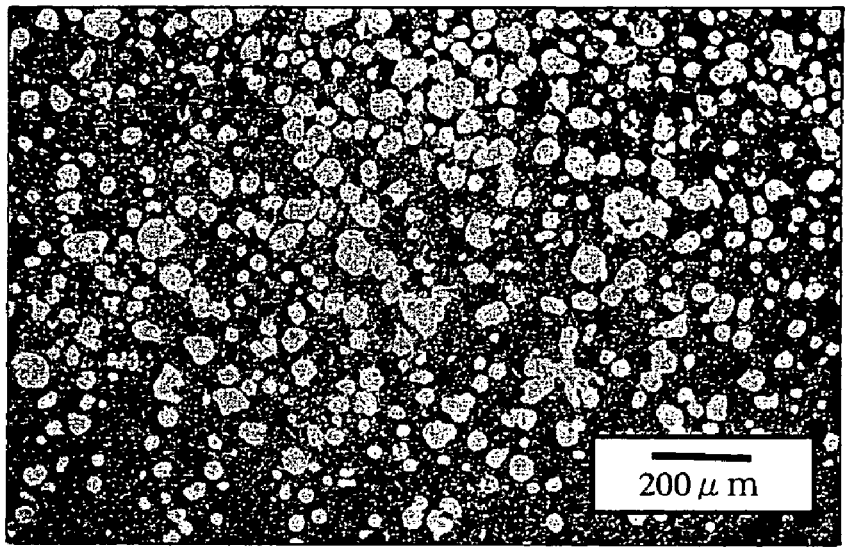
FIG. 9(A) is a view of a structure in a metallurgical micrograph of a metal product molded of a semi-solid in a solid-phase and liquid-phase coexisting state (595° C., holding time of 25 minutes)
FIG. 9(B) is a view in which the micrograph is two-valued in black and white by image processing.
Figure 9:
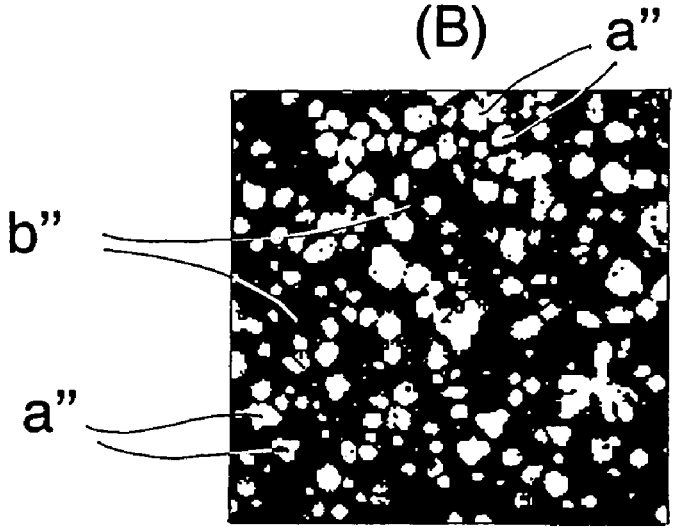

FIG. 4 is a metal structure of a solid obtained by rapidly cooling a semi-solid produced when a solid material has been melted at 590° C., and the sizes of solid phases a' are various, but in a range of 100 to 200 μm and the solid phase ratio is 48%. Further in a metal structure of a solid rapidly cooled after the semi-solid is held at a temperature of 590° C. for 30 minutes, as shown in FIG. 5, a solid-phase ratio is remarkably increased to 65%, but some sizes of solid phases a' reach 50 to 250 μm in the grain diameter, which is smaller than before melting. The reason, it is guessed, is that since the holding temperature is close to the liquidus line temperature (595° C.), a small solid phase, which is liable to be thermally influenced, is partially melted so that the size of the diameter is decreased.

In the above-mentioned semi-solids at the temperatures of 570° C. and 590° C., the almost solid phases a' are sphered and the size of the solid phase and solid-phase ratio are further increased as compared with a solid material. Further, the solid-phase ratios during melting are 48% at 590° C., and 64% at 570° C. That is, when the temperature is high, melted parts are increased, resulting in a decreased solid-phase ratio. However, all solid-phase ratios of the solid materials held for 30 minutes do not exceed 70% and the sizes of the solid phases a' are in a range of 50 to 200 μm. This means that if the semi-solid maintains a solid-phase and liquid-phase coexisting state, it can be pressure cast into a mold at the same set conditions in a state having thixotropic performance until at least 30 minutes have passed.

Further, a temperature of a heating means in a molding machine for maintaining the material at a semi-solid state can be set at about 5 to 15° C. higher than the temperature of a semi-solid from the time from the start of melting of the solid material to the pressure casting of the semi-solid. It is only a state in which a solid phase and a liquid phase coexist that is maintained until the pressure casting, whereby a state exists in which the thixotropic performance is produced.

In a semi-solid having a low solid phase ratio of 25% or less, even if the semi-solid is in a solid phase and liquid phase coexisting state, the liquid phase ratio is too much and the fluidity is increased. Thus, the semi-solid does not have appropriate thixotropic performance or a shortage of material resistance necessary for pressure casting, whereby the molding of the semi-solid becomes unstable. As a result, the molding of metal products cannot be carried out. On the other hand, in a semi-solid having a solid-phase ratio higher than 75%, the thixotropic performance due to the intervening of liquid phases therein is lost and it becomes extremely difficult to pressure cast the semi-solid into a mold through a nozzle. However, when the solid phase ratio of the semi-solid is in a range of 30 to 70%, pressure casting can be easily carried out by thixotropic performance, although there is a difference between the upper limit and the lower limit.

It is preferred that the pressure casting of the semi-solid into a mold is carried out by use of a nozzle having a diameter of 8 to 15 mm and a gate having a thickness of 1 mm or less. If this nozzle diameter and the gate thickness are used, the semi-solid is liable to receive a shearing force when it passes through the limited nozzle and gate. Thus the solid-phases a' are subdivided and a metal structure having a small bias in the distribution of primary crystals a" in a metal product can be formed.

FIGS. 6 to 9 are views of structures of metal products obtained by the steps of holding semi-solids at a temperature (for 25 minutes) while providing a difference in temperature of 5° C. from 580° C. to 595° C. after setting the temperature of a heating means in a molding machine at 5° C. higher than the temperature of the semi-solids, and pressure casting each of the obtained semi-solids into a mold from a nozzle having a diameter of 8 mm through a gate having a thickness of 0.5 mm to form the metal product. In the respective structures of the semi-solids used in the molding of the metal products of FIGS. 6 to 9, the size (grain diameter) of the main solid phase is 50 μm or more, although omitted in the Figures.

In the metal product molded from said semi-solid, as apparent from the view of the structure, the main primary crystal a" is sphered in the size of 10 μm or more, and the distribution state is that the crystals are uniformly dispersed in eutectic crystals b" as a whole. The ratio of the primary crystals a" in the metal product is increased from 46% to 50% as the temperature of the semi-solid is increased from 580° C. to 590° C. However, the primary crystal a" of a metal product obtained from a semi-solid of 590° C. which is thought to be a liquidus line temperature is fined by melting and shearing so that the entire grain diameter of the crystal is decreased. However the size of the main primary crystal a" is 10 μm or more and the ratio of the crystal is maintained at 28%.

As described above, in a magnesium metal product having the primary crystal a" ratio of 20 to 50% and the size of the main primary crystal a" of 10 μm or more, a test piece of the product thickness of 0.8 mm can obtain effects of increases of 60% in elongation, 20% in hardness, 30% in tensile strength and the like in comparison with a magnesium metal product molded of a molten magnesium alloy perfectly melted at a temperature of 620° C. or more. Also, the magnesium metal product facilitates mechanical working such as pressing, cutting and the like. Further, according to this invention, the distribution of primary crystals in a metal product are more uniform than that of a metal product obtained by a conventional thixo-molding method in which a molten material is cooled to a solid-phase and liquid-phase coexisting temperature, and is agitation sheared by screw rotation, and then the obtained material is pressure cast into a mold. Thus strength of the magnesium metal product of this invention becomes more excellent.

The invention claimed is:

1. A pressure casting method of a magnesium alloy comprising the steps of:

cooling a molten magnesium alloy to a temperature at which a solid phase and a liquid phase coexist to form a partially molten state containing a solid-phase;

further cooling the partially molten state below a solidus line temperature to form a solid-phase granularly crystallized solid material, in which a ratio of primary crystals of said solid material is 55 to 65%;

partially-melting the solid material in a molding machine provided with heating means to a semi-solid body having thixotropic properties in a state in which a solid-phase and a liquid-phase coexist, so that the semi-solid has the size of a main solid phase of 50 to 250 μm and a solid-phase ratio of 30 to 70%; and pressure casting the semi-solid into a mold through a nozzle having a diameter of 8 to 15 mm and a gate while maintaining the semi-solid state, to mold a metal product having a ratio of primary crystals of 20 to 50%.

2. The pressure casting method of a magnesium alloy according to claim 1, wherein the temperature of a the heating means in the molding machine for holding the semi-solid in said semi-solid state is set at a temperature 5 to 15° C. higher than the temperature of the semi-solid from a time from the start of melting of the solid material to the pressure casting of the semi-solid.

3. The pressure casting method of a magnesium alloy according to claim 1, wherein in the pressure casting step, the gate has a dimension of 1 mm or less.

* * * * *

UNITED STATES PATENT AND TRADEMARK OFFICE

CERTIFICATE OF CORRECTION

PATENT NO. : 7,343,959 B2
APPLICATION NO. : 11/504958
DATED : March 18, 2008
INVENTOR(S) : Tetsuichi Motegi et al.

It is certified that error appears in the above-identified patent and that said Letters Patent is hereby corrected as shown below:

Title page, item [30] please add the following information:

--Foreign Application Priority Data
July 11, 2003 (JP) . . . . . 2003-195948

Related U.S. Application Data
Divisional of Application No. 10/888,447, filed on July 9, 2004--;

Column 4, line 12, “minutes” should read --minute--;

Column 4, line 39, “phases b.” should read --pleases b′.--; and

Column 6, claim 2, line 56, “of a the” should read --of the--.

Signed and Sealed this

Twelfth Day of May, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,343,959 B2
APPLICATION NO. : 11/504958
DATED : March 18, 2008
INVENTOR(S) : Tetsuichi Motegi et al.

It is certified that error appears in the above-identified patent and that said Letters Patent is hereby corrected as shown below:

Title page, item [30] please add the following information:

--Foreign Application Priority Data
July 11, 2003 (JP) . . . . . 2003-195948

Related U.S. Application Data
Divisional of Application No. 10/888,447, filed on July 9, 2004--;

Column 4, line 12, "minutes" should read --minute--;

Column 4, line 39, "phases b." should read --phases b′.--; and

Column 6, claim 2, line 56, "of a the" should read --of the--.

This certificate supersedes the Certificate of Correction issued May 12, 2009.

Signed and Sealed this

Thirtieth Day of June, 2009

John Doll

JOHN DOLL
*Acting Director of the United States Patent and Trademark Office*